United States Patent [19]

Lepand et al.

[11] Patent Number: 4,710,244

[45] Date of Patent: Dec. 1, 1987

[54] DREDGER TEETH

[75] Inventors: Heinz Lepand; Margrit Hüser; Franz-Josef Biniasz; Axel Fuchs, all of Dortmund, Fed. Rep. of Germany

[73] Assignee: Hoesch Aktiengesellschaft, Fed. Rep. of Germany

[21] Appl. No.: 928,615

[22] Filed: Nov. 4, 1986

Related U.S. Application Data

[63] Continuation of Ser. No. 718,168, Apr. 1, 1985, abandoned.

[30] Foreign Application Priority Data

Apr. 3, 1984 [DE] Fed. Rep. of Germany ..... 3412405

[51] Int. Cl.[4] ..... C22C 38/18

[52] U.S. Cl. ..... 148/333; 420/104

[58] Field of Search ..... 148/333; 420/104

[56] References Cited

U.S. PATENT DOCUMENTS

| | | | |
|---|---|---|---|
| 3,973,951 | 8/1976 | Satsumabayashi et al. | 148/333 |
| 4,459,162 | 7/1984 | Norstrom et al. | 148/333 |

FOREIGN PATENT DOCUMENTS

| | | | |
|---|---|---|---|
| 479901 | 3/1972 | Japan | 148/333 |
| 0667609 | 6/1979 | U.S.S.R. | 148/333 |
| 1067078 | 1/1984 | U.S.S.R. | 148/333 |

*Primary Examiner*—L. Dewayne Rutledge
*Assistant Examiner*—Deborah Yee

[57] ABSTRACT

The invention concerns the use of a wear resistant, temper resisting steel alloy of

| | |
|---|---|
| 0.30 to 0.40% | carbon |
| 1.0 to 1.60% | silicon |
| 0.50 to 0.80% | manganese |
| 2.0 to 2.6% | chromium |
| maximum 0.025% | phosphorus |
| maximum 0.025% | sulfur |
| the remainder iron and limited contaminants. | |

The alloy is used as the work material for making dredger teeth forged in a close-die, especially suction dredger teeth, which teeth after the forging are heated to a temperature above the $A_3$ temperature, are hardened in oil and tempered.

4 Claims, 3 Drawing Figures

500:1

LIGHT MICROPHOTOGRAPH

24000:1

ELECTRON MICROPHOTOGRAPH

DREDGER TEETH

This is a continuation of Ser. No. 718,168, filed on 4/1/85, now abandoned.

In earth moving work, such as involved in the building and improving of canals and harbor facilities as well as in raw material mining, dredgers, or suction dredger ships, are used to move and mine materials and minerals on land and underwater.

A basic delivery unit in the ship dredging art is the suction dredge in which a rotating cutter head works according to the principle of a milling cutter. On the individual blades of the cutter head are welded adapters in tangential arrangement. The actual work tools, that is the teeth, are fastened to the adapters by means of a clamping mechanism for the purpose of making them quickly exchangeable. Since the cutter head often works under difficult conditions of use, the teeth, for example when working with rocky floors under seawater, often have a service life of only up to fifteen minutes. This high wear of the teeth or of their points causes, according to the nature or composition of the soil and involved media, a usage of as many as one hundred pieces per month per suction dredger ship and influences as a result and to a high degree the productivity of the equipment.

As investigations have shown, the work tools, that is the dredger teeth, in the discussed method are in the first place subjected to a sliding wear, that is an abrasion process resulting from the engagement of the outer surface of the teeth with the mineral materials, and in the use of dredger teeth in water, especially seawater, this process is amplified by corrosion. Moreover, the teeth are subjected to heavy mechanical loads (pressure, bending, torsion and impact) producing a requirement for a high degree of form and shape retaining strength.

The requirements imposed on dredger teeth, especially suction dredger teeth, are therefore seen to be a high hardness, especially to form a sufficient resistance to the impressing of material particles into the surface of the teeth, a high tensile strength associated with the hardness with sufficient corrosion resistance especially to impede separation of material from the surface of the teeth, further a suitable toughness to reduce the formation of cracks and finally a good resistance to tempering, since the teeth when working with difficulty in hard floors are subjected to relatively high heating loads through frictional heat so that the hardness and strength and also the wear resistance can be reduced through tempering effects.

In known ways dredger teeth as well as suction dredger teeth are used made of cast steel of different quality. Not in the least to achieve a high wear strength cast steel is predominantly alloyed with Cr-Mo, Cr-Ni-Mo or Cr-Mo-V; and the work tools are generally hardened and tempered to a working hardness of from 48–50 HRC. Used for example are 26 MnCrNiMo 4 8, 23 CrNiMo 747, 34 CrNiMo 6, 48 CrMoV 67, X 38 CrMoV 51. Apart from the relatively high basic cost of the work material because of the high alloying constituents, cast dredger teeth with about 30 J at room temperature exhibit collectively relatively poor toughness properties. Therefore, dredger teeth, especially suction dredger teeth, are forged in known ways from the aforementioned relatively expensive work materials primarily to improve their toughness.

The invention has as its object to avoid the disadvantages previously attendant the precedingly discussed requirements and to provide a cost effective, forgeable, temper resisting steel for dredger teeth which nevertheless possesses hardness and toughness along with the corrosion resistance especially required for suction dredger teeth and therefore to provide in general a wear resistance of the required degree.

BRIEF DESCRIPTION OF THE DRAWINGS

To better appreciate how the present invention meets the object of providing a cost-effective, forgible, temper retaining steel for dredger teeth which nevertheless possesses hardness and toughness along with corrosion resistance, the following drawings will be helpful, in which.

Figure 1:
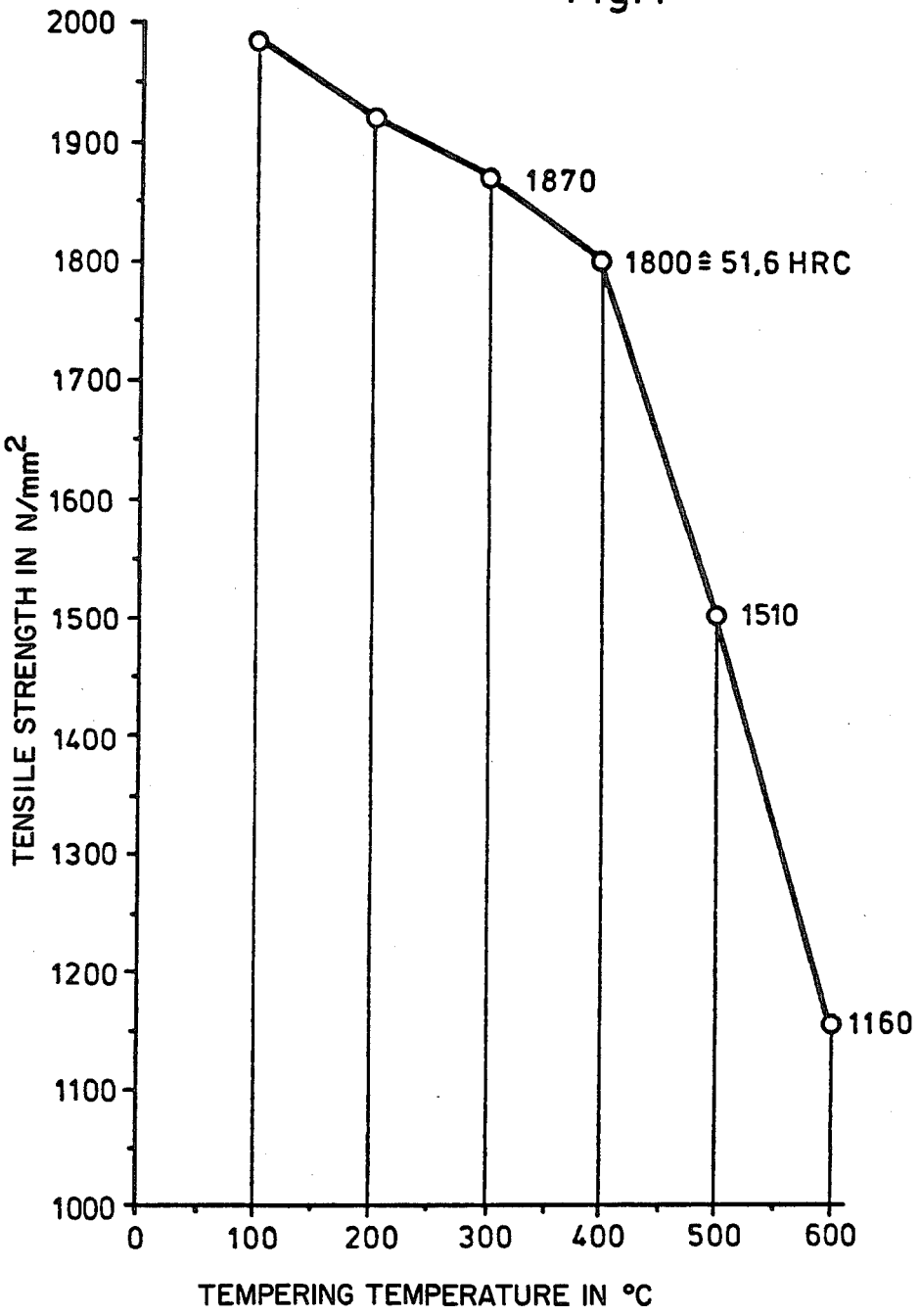
FIG. 1 is a graph illustrating the relationship between the tensil strength of the steel and its tempering temperature.

For solving this problem the invention teaches the use of a steel alloy of

| | |
|---|---|
| 0.30 to 0.40% | carbon |
| 1.0 to 1.60% | silicon |
| 50 to 0.80% | manganese |
| 2.0 to 2.6% | chromium |
| Maximum 0.025% | phosphorus |
| Maximum 0.025% | sulfur |
| Remainder iron and limited contaminants. | |

In a further embodiment of the invention a steel alloy of the following composition preferably is used:

| | |
|---|---|
| 0.32 to 0.38% | carbon |
| 1.10 to 1.50% | silicon |
| 0.50 to 0.80% | manganese |
| 2.10 to 2.50% | chromium |
| Maximum 0.025% | phosphorus |
| Maximum 0.025% | sulfur |
| Remainder iron and limited contaminants. | |

For the handling of the steel alloy composed in accordance with the invention it is especially advantageous if it is forged in a close die at a forging temperature of from 1,150° to 1,250° C., heated to a temperature of 880° C., quenched (hardened) in oil and subsequently tempered at a temperature of below 400° C.

Of further essential significance to the invention—as apparent from the following embodiments—the steel alloy after the forging, hardening and tempering has a structure of fine structured martensite with few fine embedded carbides ($M_3C$) and a carbide size of from 30–80 nm as well as a compact flow pattern, a yield point of more than 1,550 N/mm$^2$, a tensile strength of 1,800–1,880 N/mm$^2$, an elongation of more than 10%, a reduction of area of more than 35%, as well as a hardness of more than 51 HRC and an impact value of more than 40 J at room temperature (measured on ISO-V Tester).

The advantages of the invention are particularly to be seen in that with the proposed usage a cost effective, temper resisting steel for dredger teeth, especially suction dredger teeth can be made, which nevertheless has hardness and toughness along with corrosion resistance as required especially for suction dredger teeth and which thereby collectively possesses a wear resistance in the required degree.

The invention is described below in more detail through exemplary embodiments.

Round rods with a diameter of 30 mm were forged from a steel with 0.35% C, 1.15% Si, 0.60% Mn and 2.39% Cr, 0.024% P, 0.021% sulfur, and the rest iron, after determination of the $A_{C3}$-temperature the hardening temperature was fixed at 880° C./quenched in oil.

For determining the most advantageous tempering temperature a portion of the rods were tempered at temperatures of 200°, 250°, 300° and 350° C. Hardness measurements over the cross section of the test specimens gave the following values with complete through hardening respectively through tempering:

| HARDENED | TEMPERED AT | | | |
|---|---|---|---|---|
| 880° C. 30 minutes in oil | 200° C. | 250° C. | 300° C. | 350° C. |
| HV 10 598 | 580 | 571 | 565 | 562 |
| corresponding HRC 54.8 | 53.7 | 53.1 | 52.8 | 52.6 |

The results show that the hardness of the work material falls off only slightly with increasing tempering temperatures. After tempering at 350° C. the steel still possesses a hardness of 52.6 HRC. This hardness accordingly is somewhat higher than the working hardness of 48 to 50 HRC required for suction dredger teeth.

The good temper resisting quality shown by the hardness measurements of the developed work material was verified by hot tensile strength tests at 100° to 600° C. The temper curve according to FIG. 1 shows initially with increasing temperature a slight decrease and then an abrupt fall off in strength beginning at 400° C. Starting with a tensile strength of 2,000 N/mm$^2$ set by the hardening (880° C. in oil) the steel still has a tensile strength of 1,800 N/mm$^2$ at a tempering temperature of 400° C., that is at 400° C. it has a hardness of about 51.5 HRC which is still above the required working hardness for dredger teeth, and shows therefore a good resistance to tempering. This means also that after the forging and hardening the tempering temperature can be increased from 350° C. to 400° C. and thereby the toughness of the work material can be improved without essentially influencing its wear resistance—that is, its resistance to abrasion.

Figure 2A:
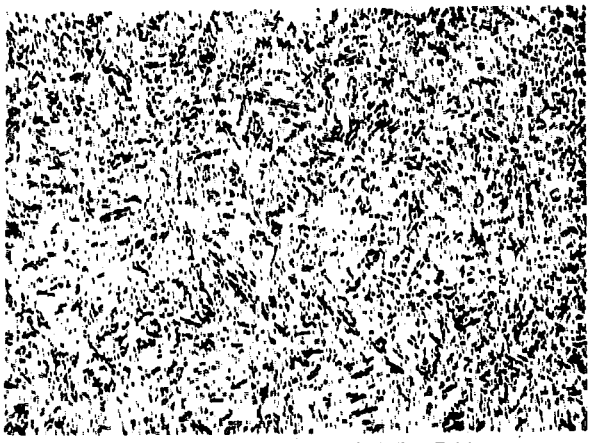
FIG. 2*a* is a light microphotograph and depicts the structure of the steel after heat treatment.
Figure 2B:
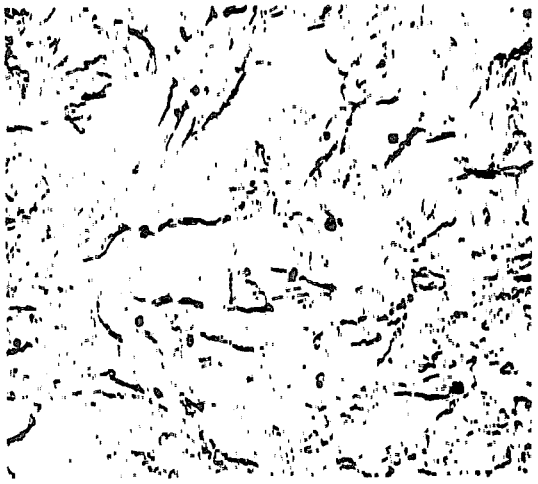
FIG. 2*b* is an electron microphotograph and also depicts the structure of the steel after heat treatment.

The structure of the heat treated steel is shown in FIGS. 2*a* and 2*b*, FIG. 2*a* being a light microphotograph and FIG. 2*b* being an electron microphotograph. The structure consists of finely structured tempered martensite with little fine embedded carbides ($M_3C$) of a size from 30 to 80 nm.

In comparison investigations dredger teeth made from the foregoing work material in accordance with the invention (work material A) were forged, hardened and tempered, and as test specimens were compared with test specimens consisting of customary commercial cast steel of the quality GS 26 MnCrNiMo 4 8 (work material B), which commercial teeth in their line are designated as especially wear-resistant.

The results of the tests of the two work materials (in identical test situations) are compared in the following table:

| Work Material | Yield Point N/mm$^2$ | Tensile Strength N/mm$^2$ | Elongation % | Reduction of Area % | Hardness HV 10 | ISO-V Tester CV J/RT |
|---|---|---|---|---|---|---|
| A | 1610 | 1880 | 10.4 | 48.0 | 563 | 45/44/44 |
| | 1610 | 1870 | 10.8 | 46.5 | | |
| B | 1401 | 1631 | 3.6 | 4.0 | 510 | 29/36/27 |
| | 1439 | 1656 | 5.0 | 4.0 | | |

This shows that the forged work material has a higher yield point by about 190 N/mm$^2$ and has a higher tensile strength by about 240N/mm$^2$ while at the same time having considerable better elongation, reduction of area and impact strength values, in comparison to the cast work material.

For further investigations, steel with 0.36% C, 1.27% Si, 0.62% Mn, 0.019% P, 0.015% S, and 2.30% Cr (work material C) was forged into teeth in a close-die, was hardened in oil at 880° C. without work material distortion and tempered at 350° C. Spot tests gave a tooth hardness of between 52.4 and 52.9 HRC. These teeth were tested under working conditions and compared with teeth made according to the state of the art from cast work material GS 26 MnCrNiMo 4 8 (work material D).

The test was carried out with a cutter head with six blades having seven adapters each blade; during the investigation the soil conditions were constant. The soil was a middle heavy limestone soil under seawater with a compression strength of from 30 to 80 kp/cm$^2$.

Two investigations were carried out:

1. First Investigation:

All blades were equipped with teeth from work material C according to the invention; the running time of the cutter head was 17 hours, 50 minutes; during this time a mass of 24,100 m$^3$, corresponding to 1.351 m$^3$ per hour was delivered.

2. Second Investigation:

All teeth were equipped with teeth made of work material D; the running time of the cutter head was 19 hours, 50 minutes; during this time a mass of 18,200 m$^3$ corresponding to 918 m$^3$ per hour was delivered.

The teeth were measured and weighed at the beginning and at the end of the investigations.

Table 1 shows the tabulation and evaluation of the most important results of both investigations.

With respect to the initial length, the teeth of work material C according to the invention lost an average of 6.40 cm, while the teeth of the comparison material D lost 8.94 cm. This corresponds to a 39.7% higher wear of the teeth of work material D in comparison to the teeth of material C. The evaluation of the teeth weights produced a similar result. The teeth of work material C on average had a weight loss of 2.05 kg while the teeth of work material D had a weight loss of 2.97 kg, which amounts to a 44.9% higher loss of weight.

If this wear is related to the delivered material it is shown that with the teeth of work material C 85% more material can be delivered than with the comparison teeth before the same wear as to length appears, and 92% more before the same weight loss appears. The considerably heavier wear of the comparison teeth with respect to the teeth of the invention is still more meaningful if the delivery performance in $m^3$ per hour is taken into consideration. For similar wear in teeth length the delivery performance in $m^3$ per hour of the inventive teeth is about 104.9% improved with respect to the comparison teeth, and with the same weight loss the delivery performance in $m^3$ per hour is improved 113.3%. Not of least significance, as shown by further metallographic investigations, because of the shaping work during forging the teeth of the invention in a close-die an especially compact flow pattern is realized whereby their form strength is considerably increased with respect to that of cast comparison teeth. In any event the improved toughness represents a special advantage in the use of the teeth under the most difficult conditions.

TABLE 1

| INVESTIGATION | RUNNING TIME HR | RUNNING TIME MIN | DELIVERED MASS ($m^3$) | DELIVERY RATE ($m^3$/h) | LENGTH LOSS OF THE TEETH (AVERAGE VALUE) (cm) | WEIGHT LOSS OF THE TEETH (AVERAGE VALUE) (kg) | DELIVERED MASS ($m^3$) per 1 cm of length loss | DELIVERED MASS ($m^3$) per 1 kg of weight loss | DELIVERY RATE ($m^3$/h) per 1 cm of length loss | DELIVERY RATE ($m^3$/h) per 1 kg of weight loss |
|---|---|---|---|---|---|---|---|---|---|---|
| WORK MATERIAL C | 17 | 50 | 24,100 | 1,351 | 6.40 | 2.05 | 3,766 | 11,756 | 211 | 659 |
| WORK MATERIAL D | 19 | 50 | 18,200 | 918 | 8.94 | 2.97 | 2,036 | 6,128 | 103 | 309 |

We claim:

1. A wear resistant and temper resisting steel which has been forged, hardened and tempered for use as a work material in dredger teeth, said steel consisting of:

| | |
|---|---|
| 0.30–0.40% | carbon |
| 1.0–1.60% | silicon |
| 0.50–0.80% | manganese |
| 2.0–2.6% | chromium |
| maximum 0.025% | phosphorus |
| maximum 0.025% | sulfur, and |

-continued

| |
|---|
| the remainder iron and contaminants in normal quantities. |

2. A steel as set forth in claim 1 further characterized in that the carbon, the silicon and the chromium components are limited to the following ranges:

| | |
|---|---|
| 0.32–0.38% | carbon |
| 1.10–1.50% | silicon, and |
| 2.10–2.50% | chromium |

3. A steel as set forth in claim 1 wherein said steel is formed by forging in a closed die at a forging temperature from 1,150° to 1,250° C., hardening in oil heated to a temperature of 880° C. and tempering at a temperature below 400° C.

4. A steel as set forth in claim 1 further characterized in that after the forging, hardening and tempering, said steel has a structure of finely structured martensite with few fine embedded carbides ($M_3C$) and a carbide size of from 30–80 nm as well as a compact flow pattern, a yield point of more than 1,500 N/mm$^2$, a tensile strength of from 1,800–1,880 N/mm$^2$, an elongation of more than 10%, a reduction of area of more than 35% as well as a hardness of more than 51 HRC and an impact strength of more than 40 J at room temperature measured on an ISO-V tester.

* * * * *